United States Patent [19]

Kagerhuber et al.

[11] 4,046,188

[45] Sept. 6, 1977

[54] ARCUATE SUPPORTING AND GUIDING CONSTRUCTION FOR CONTINUOUSLY CAST STRANDS

[75] Inventors: Franz Kagerhuber, Traun; Werner Scheurecker, Linz, both of Austria

[73] Assignee: Vereinigte Osterreichische Eisen- und Stahlwerke - Alpine Montan Aktiengesellschaft, Linz, Austria

[21] Appl. No.: 725,717

[22] Filed: Sept. 23, 1976

[30] Foreign Application Priority Data

Oct. 1, 1975 Austria ..... 7486/75

[51] Int. Cl.[2] ..... B22D 11/12

[52] U.S. Cl. ..... 164/282; 226/186; 226/194

[58] Field of Search ..... 226/186, 190, 194; 164/282

[56] References Cited

U.S. PATENT DOCUMENTS

| | | | |
|---|---|---|---|
| 3,920,065 | 11/1975 | Hall | 164/282 |
| 3,963,069 | 6/1976 | Marti | 164/282 |

*Primary Examiner*—Richard A. Schacher
*Attorney, Agent, or Firm*—Brumbaugh, Graves, Donohue & Raymond

[57] ABSTRACT

A supporting and guiding arc for a cast strand has roller-carrying arcuate longitudinal carriers arranged in a stationary framework, which carriers support the strand at opposite sides. At least the roller-carrying arcuate longitudinal carriers arranged at one side of the strand are braceable relative to the framework under elastic deformation for adjustment to various strand thicknesses. All of the longitudinal carriers arranged at one side of the strand are connected to transverse carriers which are movably guided on drawing anchors secured to the framework, and the transverse carriers are fixable relative to the drawing anchors.

4 Claims, 7 Drawing Figures

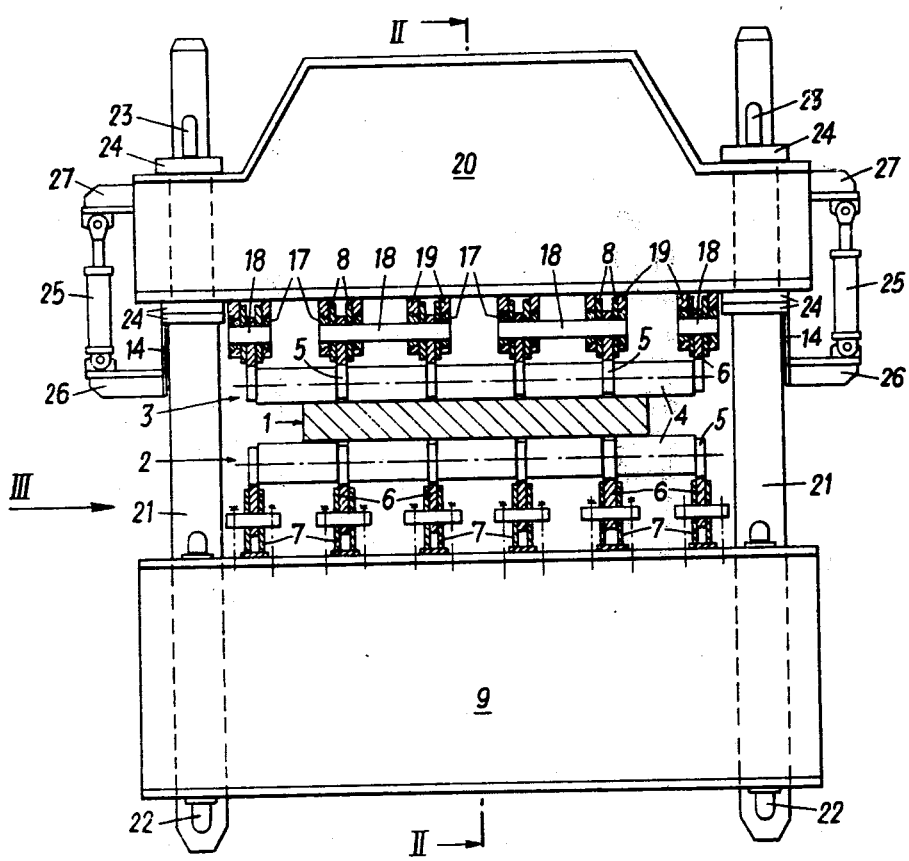

ARCUATE SUPPORTING AND GUIDING CONSTRUCTION FOR CONTINUOUSLY CAST STRANDS

BACKGROUND OF THE INVENTION

The invention relates to a supporting and guiding arc for cast strands, in particular for cast slabs, which arc has arcuate longitudinal carriers with rollers supporting the strand at opposite sides. The arcuate longitudinal carriers are arranged in a stationary framework and either the inner or the outer or both of the roller-carrying arcuate longitudinal carriers are adjustable or braceable relative to the framework under elastic deformation for adjustment to various strand thicknesses.

Such a supporting and guiding arc, as described e.g. in Austrian Pat. No. 290,750 (U.S. Pat. No. 3,710,847), makes it possible to set the opposite roller paths at various distances, while preventing points of discontinuity.

However, the readjustment of such a supporting and guiding arc from one strad thickness to another one requires much time particularly the rollers are mutiply journaled due to their great length, i.e. when the rollers of each roller path rest — via a number of arcuate longitudinal carriers distributed over their longitudinal extension — against the framework. In that case with the known guiding arc it is necessary, for changing the roller distance, to detach the means fastening the arcuate longitudinal carriers to the framework, to exchange the washers provided at the fastening points for other ones having a different thickness and then to again rigidly connect the arcuate longitudinal carriers at all their fastening points with the framework. The great number of manipulations gives rise to sources of mistakes and inaccuracies.

SUMMARY OF THE INVENTION

The invention aims at preventing the above-defined difficulties and has as its object to create a supporting and guiding arc of the above-defined kind that can be readjusted more rapidly, in a more simple manner and more precisely to various strand thicknesses by reducing the number of manipulations to be carried out on the guiding arc for a change of the strand thickness.

According to the invention, this object is achieved in that all the arcuate longitudinal carriers are connected on at least one side of the strand with transverse carriers arranged at a distance from one another, wherein the transverse carriers are guided on and fixable relative to drawing anchors secured to the framework.

According to a preferred embodiment, each one of the drawing anchors is provided with two bushings forming a thread with corresponding helical sliding faces having an angle of inclination that is smaller than the pertaining angle of friction. Each outer one of the bushings is rigidly connected with the drawing anchor and the inner one of the bushings, which rests on the transverse carrier via spacers, is rotatable relative to the outer bushing by means of a pressure medium cylinder, whereby the transverse carrier is made movable and thus the rollers can be brought into and out of engagement position. Thus the arcuate longitudinal carriers are detachable from the framework simultaneously and by remote control, and the readjustment of the guiding arc can take place even more quickly. Due to the quick operation of the pressure medium cylinder this embodiment also helps preserve the rollers if the strand gets stuck. Manipulations by hand would not be possible in the vicinity of the slab because of the great heat prevailing there.

According to a further preferred embodiment, each one of the drawing anchors is connected with the transverse carrier via a pressure medium cylinder arranged in the axial direction of the drawing anchor.

For easy operation of the supporting and guiding arc, suitably each one of the drawing anchors, at the end guiding the transverse carrier, is connected with the piston rod of a pressure medium cylinder secured to the transverse carrier and arranged in the axial direction of the drawing anchor.

BRIEF DESCRIPTION OF THE DRAWINGS

The invention shall now be described by way of a number of examples (in this case for a slab plant having such a great slab width that its rollers are supported at six points and with reference to the accompanying drawings, wherein.

DESCRIPTION OF EXEMPLARY EMBODIMENTS

Figure 1:
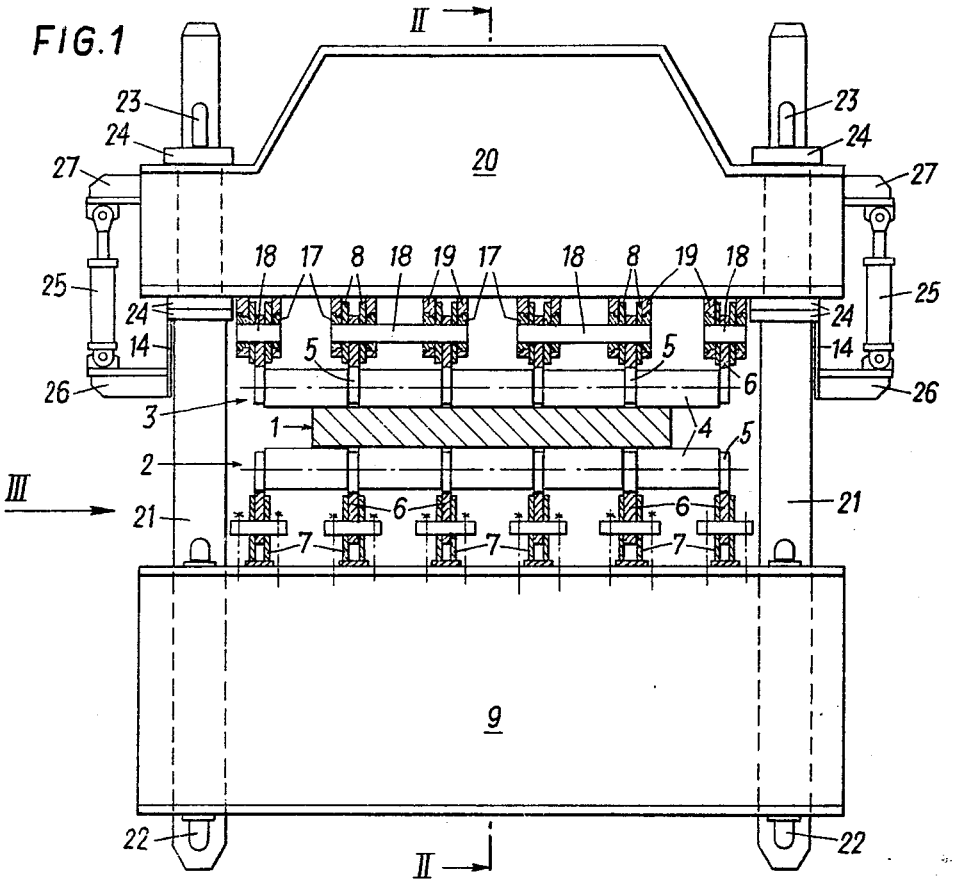
FIG. 1 is a section transverse to the longitudinal direction of the roller paths.
Figure 2:
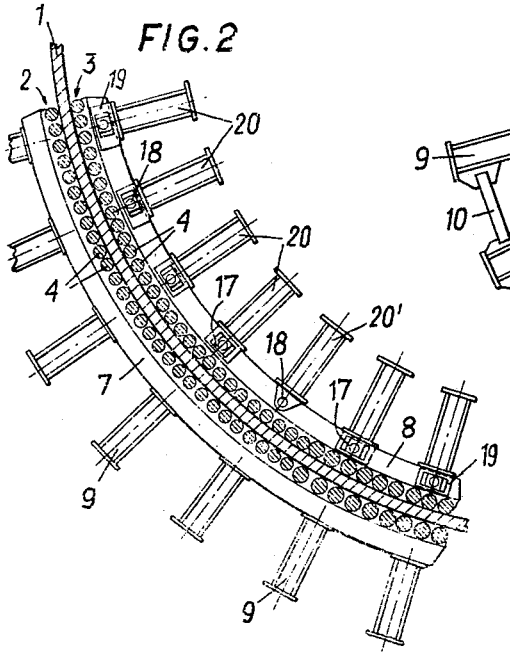
FIG. 2 is a schematically illustrated vertical section along line II — II of FIG. 1 omitting the framework props.

A strand, denoted with 1, is supported and guided between roller paths 2 and 3. The rollers 4 of both roller paths are inserted with their holding means 5 in bearing supports 6, which are secured to arcuate longitudinal carriers 7 and 8. In order to prevent an all too pronounced sagging of the long and relatively thin rollers 4, the embodiment illustrated shows six holding means 5 distributed over the longitudinal extension of the rollers.

Figure 3:
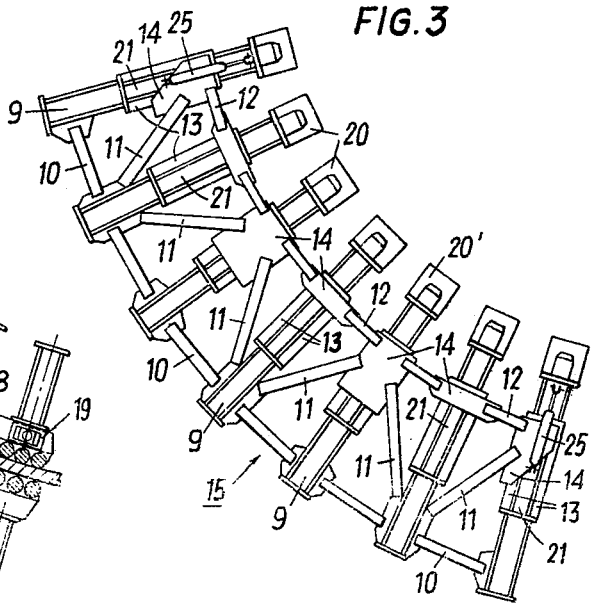
FIG. 3 is a schematically illustrated view of the framework in the direction of the arrow III of FIG. 1.
Figure 4:
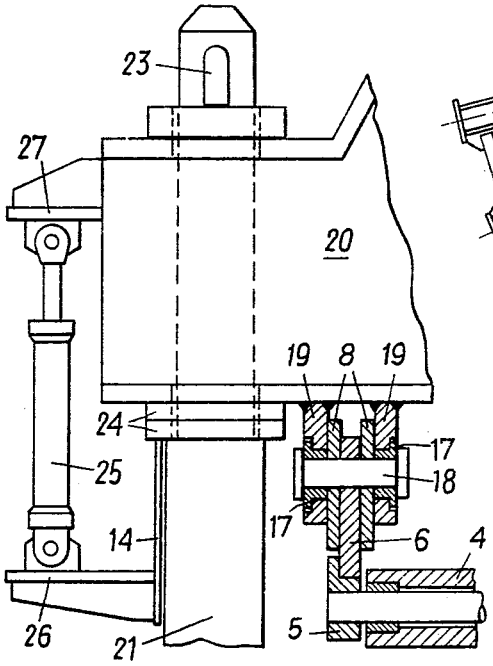
FIG. 4 shows a detail of the roller fastening on the transverse carrier as well as the arrangement of the transverse carriers on the drawing anchor, in the same manner as in FIG. 1, but on an enlarged scale.

The arcuate longitudinal carriers 7 carrying the rollers of the roller path 2 arranged at the outer side of the arc, are screwed to spaced transverse carriers 9 of an arcuate, stationary framework 15 composed of props 10, 11, 12 and 13 connecting the transverse carriers (see FIG. 3). The props 11, 12 and 13 are connected to one another by gussets 14.

The arcuate longitudinal carriers 8 carrying the rollers arranged on the inner side of the arc, via bolts 18 and sliding blocks 17 mounted on the bolts, rest in supporting brackets 19 welded to a transverse carrier 20. The sliding blocks 17 and the transverse carriers 20 are arranged along the arcuate longitudinal carriers 8 in such a manner that one transverse carrier 20 each lies opposite a transverse carrier 9 of the arcuate, stationary framework 15. These opposing transverse carriers are detachably connected with each other by drawing anchors 21 arranged at right angles to the roller paths and at both sides thereof. Each drawing anchor with one end penetrates the transverse carrier 9 of the framework 15, to which transverse carrier it is fastened by means of the wedge connection 22. Each drawing anchor, with its other end, penetrates the transverse carrier 20 of the roller path 3 on the inner side of the arc and is also fixable to it by a wedge connection 23 and interposed exchangeable spacers 24. One of the transverse carriers 20', arranged in about the middle of the roller paths, is connected with the arcuate longitudinal carriers 8 not by a sliding block, but only by the bolt 18.

For adjusting the roller path distance to various strand thicknesses and for bending the arcuate longitudinal carriers 8 on the inner side of the arc, the transverse carriers are displaced by pressure medium cylinders 25 along the drawing anchors into the position corresponding to the new strand thickness, after the wedge connections 23 have been detached and the spacers 24 have been removed. Then, once suitable spacers 24 have inserted at both sides of the transverse carrier 20, the wedge connection can be established again. This process must start from the middle transverse carrier denoted with 20'. Subsequently the transverse carriers 20 are adjusted and fixed one after the other starting from those transverse carriers arranged adjacent the transverse carrier 20'. The pressure medium cylinders 25 arranged with their axes parallel to the drawing anchors 21 are each hinged at two consoles 26 and 27, one of which is rigidly fastened on the gusset 14 of the framework 15 and the other one on the transverse carrier 20. For adjusting the roller path distance to a certain strand thickness it is necessary — as shown in FIG. 3 — to arrange the pressure medium cylinders at least on the first and the last of the transverse carriers 20.

As compared to known supporting constructions, wherein the arcuate longitudinal carriers arranged at the bearing places of the rollers are each connected with a rigid transverse carrier welded into the framework by a wedge connection using spacers, the illustrated journaling of each roller at six points and the supporting of the arcuate longitudinal carriers at seven points leads to a reduction of the wedges to be detached and pushed in again during a re-adjustment of the roller distance from forty-two to only fourteen.

Figure 5:
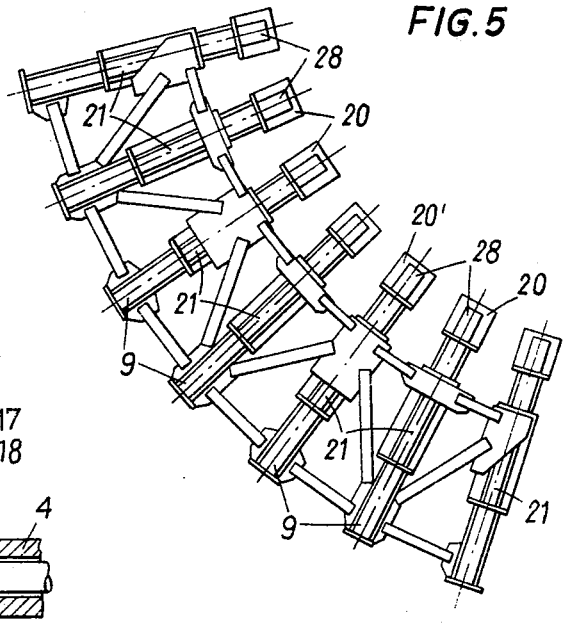
FIGS. 5 and 6 show a modified embodiment of the supporting and guiding arc according to the invention analogous to FIGS. 3 and 4.
Figure 6:
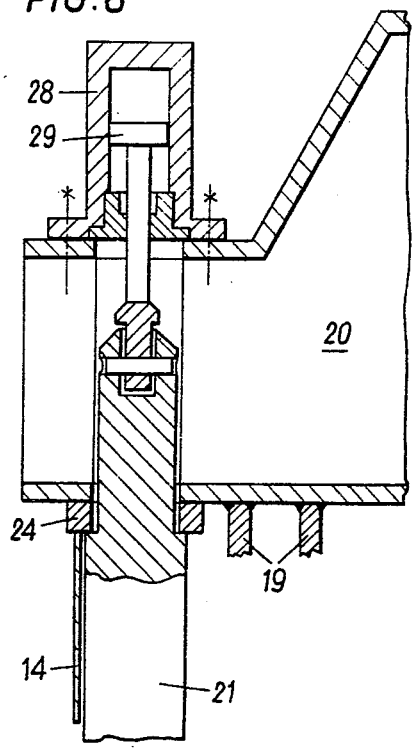

According to another embodiment of the invention shown in FIGS. 5 and 6, the wedge connection 23 arranged between the transverse carriers 20 and the drawing anchors 21 and the pressure medium cylinders 25 can be eliminated. Fastening or displacement of the transverse carriers 20 on the drawing anchor 21 is obtained because each drawing anchor at the end guiding the transverse carrier is connected with the piston rod of a pressure medium cylinder secured to the transverse carrier and arranged in the axial direction of the drawing anchor. According to this embodiment of the invention the need not be detached or pushed in when readjusting to another strand thickness; only the spacers 24 have to be exchanged by hand. The pressure medium cylinders 28 always have to be actuated during the casting operation. In order to avoid the danger of overloading the rollers, as occurs e.g. when the strand gets stuck, the roller path 3 on the inner side of the arc can be detached from the framework at once — by remote control — upon pushing a button freeing the pistons 29 of all the pressure medium cylinders 28 from the load.

Figure 7:
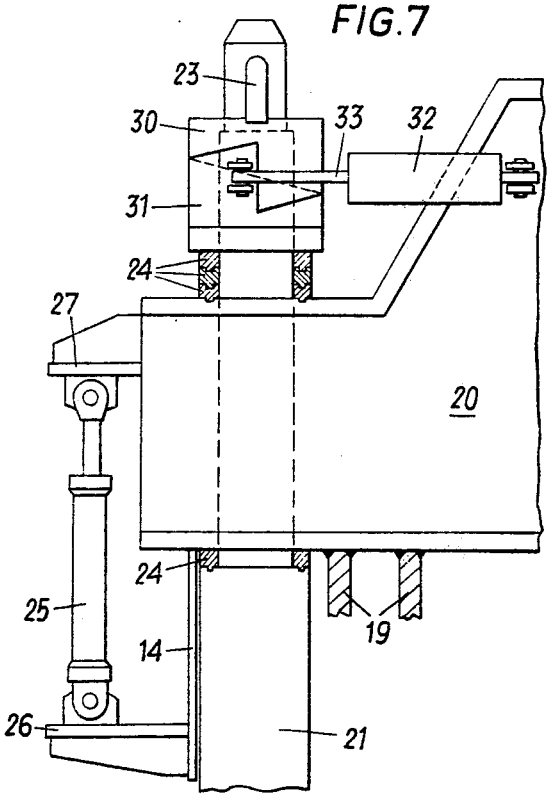
FIG. 7 shows a further embodiment of the supporting construction according to the invention in an illustration corresponding to FIG. 4.

According to another embodiment of the invention, which is shown in FIG. 7, the drawing anchors 21 are provided with two bushings 30 and 31 forming a thread with corresponding helical sliding faces having an angle of inclination that is smaller than the pertaining angle of friction. The outer bushing 30 is rigidly connected with the drawing anchor 21, and the inner one of the bushings 31, which rests on the transverse carrier 20 via spacers 24, is rotatable relative to the outer bushing by means of a pressure medium cylinder 32, whereby the transverse carrier 20 is made movable and thus the rollers can be brought into and out of an engagement position. The pressure medium cylinder is hinged to the transverse carrier 20 and, with its piston rod 33, to the inner bushing 31. The adjustment of the roller path distance to various strand thicknesses, except for the detachment and fixing of the transverse carrier 20 on the drawing anchor 21, if effected in the same manner as in the embodiment shown in FIGS. 1 to 4, i.e. by exchanging spacers. The transverse carrier 20 is parallelly displaced by the pressure medium cylinders 25. Also in this embodiment all the transverse carriers 20 are detachable from the drawing anchors simultaneously by remote control of the pressure medium cylinders 32 upon the pushing of a button. The pressure medium cylinders 32, on the basis of the self-inhibiting, helical sliding faces of the bushings 30 and 31, need only be actuated for moving the bushings, i.e. they may remain without pressure during the casting operation.

The arcuate framework is secured to the steel construction of the casting platform or to the base.

What we claim is:

1. In an arcuate supporting and guiding construction for continuously cast strands, in particular slabs, of the type including a stationary framework, a set of inner arcuate longitudinal carriers and a set of outer arcuate longitudinal carrier positioned within the framework, at least one of said sets of longitudinal carriers being elastically deformable and braceable relative to the framework for adjustment to various strand thicknesses, and a plurality of rollers connected to each of the sets of longitudinal carrier to support the strand on two opposite sides thereof, the improvement comprising transverse carriers arranged at a distance from one another and connected to all the arcuate longitudinal carriers of at least one of said sets, and drawing anchors secured to the framework, the transverse carriers being guided on the drawing anchors and fixable relative thereto.

2. An arcuate supporting and guiding construction as set forth in claim 1, further comprising an outer end and an inner bushing provided on each drawing anchor, the outer and the inner bushings having corresponding helical sliding faces with an angle of inclination that is smaller than the pertaining angle of friction each outer bushing being fixedly connected to its respective drawing anchor, spacers via which each inner bushing rests on its pertaining transverse carrier, and a pressure medium cylinder for rotating each inner bushing relative to its respective outer bushing, thus making the respective transverse carrier movable to bring the rollers into and out of engagement with the strand.

3. An arcuate supporting and guiding construction as set forth in claim 1, further comprising a pressure medium cylinder arranged in the axial direction of each drawing anchor and connecting each drawing anchor with its pertaining transverse carrier.

4. An arcuate supporting and guiding construction as set forth inclaim 3, wherein each pressure medium cylinder arranged in the axial direction of each drawing anchor and secured to its pertaining transverse carrier has a piston rod connected to the transverse-carrier-guiding end of the pertaining drawing anchor.

* * * * *

UNITED STATES PATENT OFFICE

CERTIFICATE OF CORRECTION

Patent No. 4,046,188 Dated Sept. 6, 1977

Inventor(s) Franz Kagerhuber et al.

It is certified that error appears in the above-identified patent and that said Letters Patent are hereby corrected as shown below:

Col. 1, line 21, "strad" should read --strand--; line 22, "time particularly" should read --time, particularly when-- and "mutiply" should read --multiply--. Col. 2, line 18, after "points" insert -- ) --. Col. 3, line 18, "have inserted" should read --have been inserted--; line 53, before "need" insert --wedges--.

Col. 3, last line, and Col. 4, first line, "one of the bushings" should read --bushing--. Col. 4, line 11, "if" should read --is--; line 29, "carrier" should read --carriers--; line 34, "carrier" should read --carriers--; line 44, delete "end"; line 48, after "friction" insert a comma; line 63, "inclaim" should read --in claim--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*